US007213655B2

(12) United States Patent
Parrott

(10) Patent No.: US 7,213,655 B2
(45) Date of Patent: May 8, 2007

(54) SYSTEM FOR CONNECTING DOWNHOLE TOOLS

(75) Inventor: Robert A. Parrott, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 68 days.

(21) Appl. No.: 10/708,766

(22) Filed: Mar. 24, 2004

(65) Prior Publication Data

US 2005/0155770 A1 Jul. 21, 2005

Related U.S. Application Data

(60) Provisional application No. 60/536,674, filed on Jan. 15, 2004.

(51) Int. Cl.
*E21B 17/042* (2006.01)

(52) U.S. Cl. ..... 166/380; 166/242.6; 166/240; 166/55; 285/18; 285/305; 285/330; 285/391

(58) Field of Classification Search ..... 166/380, 166/242.6, 240, 55, 55.1; 285/330, 391, 285/18, 305; 464/137, 149, 89, 20; 411/544, 411/368, 160, 161, 164
See application file for complete search history.

(56) References Cited

U.S. PATENT DOCUMENTS 2,296,198 A * 9/1942 Boynton ..... 285/330
3,888,320 A 6/1975 Maxwell
5,341,880 A 8/1994 Thorstensen et al.
5,415,441 A 5/1995 Kilgore et al.
5,452,923 A * 9/1995 Smith ..... 285/330
6,059,042 A 5/2000 Huber et al.
6,123,152 A 9/2000 Edwards et al.
6,155,344 A 12/2000 Myers et al.
6,168,213 B1 1/2001 Muller
6,257,792 B1 7/2001 Read, Jr.
6,397,752 B1 6/2002 Yang et al.
6,481,498 B1 * 11/2002 Ackroyd et al. ..... 166/242.6
6,648,071 B2 11/2003 Hackworth et al.
6,658,981 B2 12/2003 Rochen et al.

* cited by examiner

*Primary Examiner*—Jennifer H. Gay
*Assistant Examiner*—Matthew J. Smith
(74) *Attorney, Agent, or Firm*—Trop, Pruner & Hu, P.C.; Bryan P. Galloway; Jaime A. Castano

(57) ABSTRACT

A hands-free connection system is provided for coupling downhole tools for use in well operations. The connection system includes two downhole tools connectable together in threaded engagement. The connection system further includes a compressible locking sleeve positioned between the coupled downhole tools for maintaining the tools in threaded engagement and in a predetermined alignment for deployment downhole.

29 Claims, 9 Drawing Sheets

SYSTEM FOR CONNECTING DOWNHOLE TOOLS

CROSS-REFERENCE TO RELATED APPLICATIONS

The present application claims the benefit of U.S. Provisional Patent Application Ser. No. 60/536,674, filed Jan. 15, 2004.

TECHNICAL FIELD

The present invention relates generally to connecting tools used in downhole applications, and more particularly to a connection system for fastening perforating guns together to form a tool string for use in a well.

BACKGROUND

After a well has been drilled and casing has been cemented in the well, one or more sections of the casing may be perforated using a string of perforating guns. After the perforating string is lowered into the well to a desired depth, the guns in the string are fired to create openings in the casing and to extend perforations into the surrounding formation. Production fluids in the perforated formation can then flow through the perforations and the casing openings into the wellbore.

In deploying a perforating string in a wellbore, the tools are usually assembled into a relatively long and heavy string, with the string suspended over and run into the wellbore. The perforating string includes a number of perforating guns coupled or fastened together in series, along with other components. The perforating guns are generally aligned in a predetermined pattern as a function of the desired perforation of the well formation.

Present fastening practices typically involve assembling the string manually at the surface before running into the wellbore. Such practices may be subject to human error, inefficiencies, and potential safety hazards. Accordingly, a need exists for a system to couple downhole tools together in series to form a tool string that may be automated and that yields a more reliable connection. The present invention is directed at providing such a system.

SUMMARY

In general, according to one embodiment of the present invention, a system for use in connecting downhole tools together in series to form a tool string is provided.

In general, according to another embodiment of the present invention, a system for connecting downhole tools together in series comprises an upper tool, a lower tool, and a sleeve arranged between the upper and lower tools for locking the tools together.

In general, according to yet another embodiment of the present invention, a system for connecting perforating guns together to form a perforating string comprises an upper gun assembly, a lower gun assembly having an axial bore therethrough for receiving the upper gun assembly, and a locking sleeve arranged between the gun assemblies for orienting the upper gun with respect to the lower gun and for locking the gun assemblies together.

Other or alternative features will be apparent from the following description, from the drawings, and from the claims.

BRIEF DESCRIPTION OF THE DRAWINGS

The manner in which these objectives and other desirable characteristics can be obtained is explained in the following description and attached drawings in which.

Figure 1:
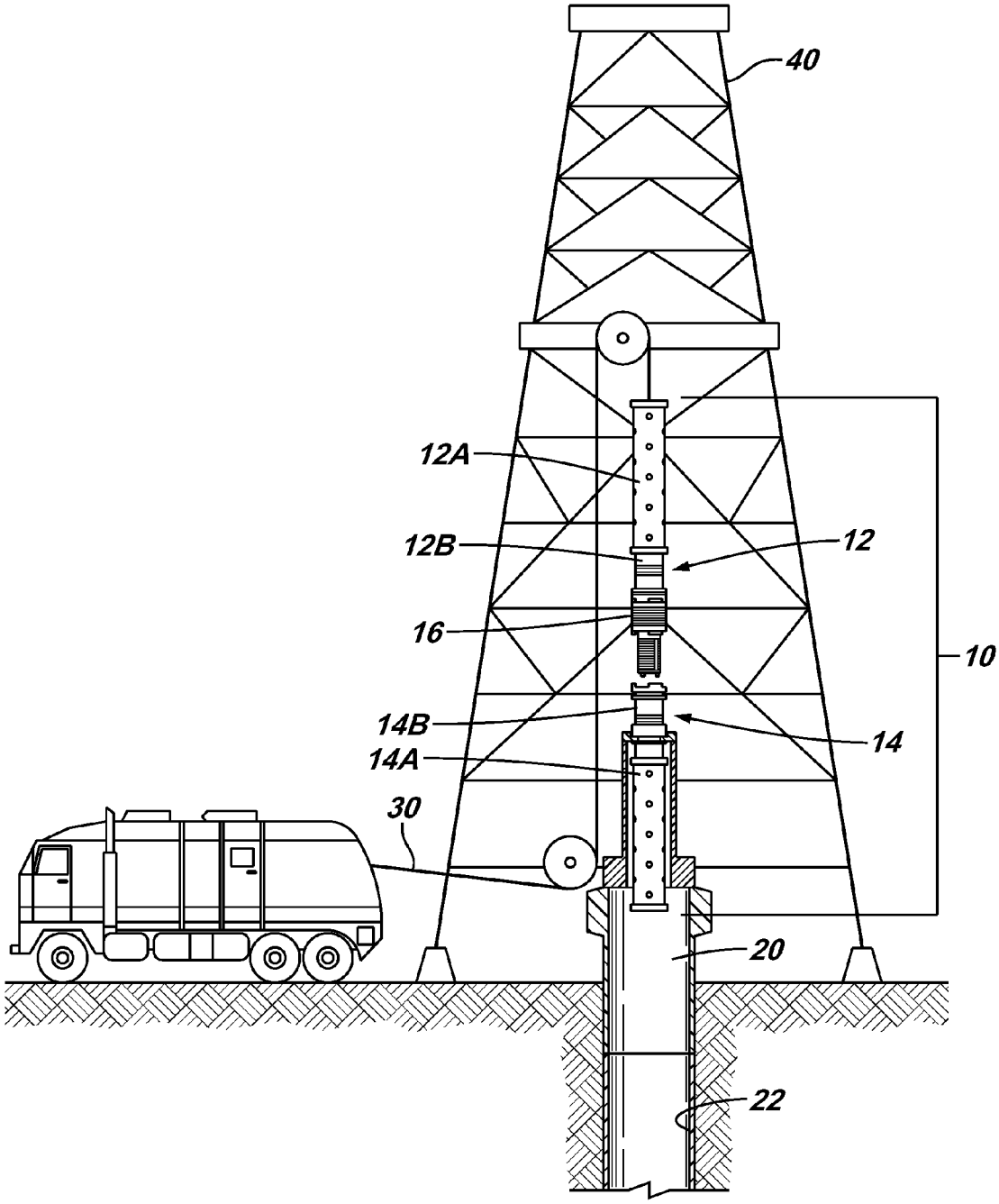
FIG. 1 is an elevation view of an embodiment of the connection system of the present invention illustrating the formation of a perforation string for use in a wireline-conveyed well completion operation on land.
Figure 2A:
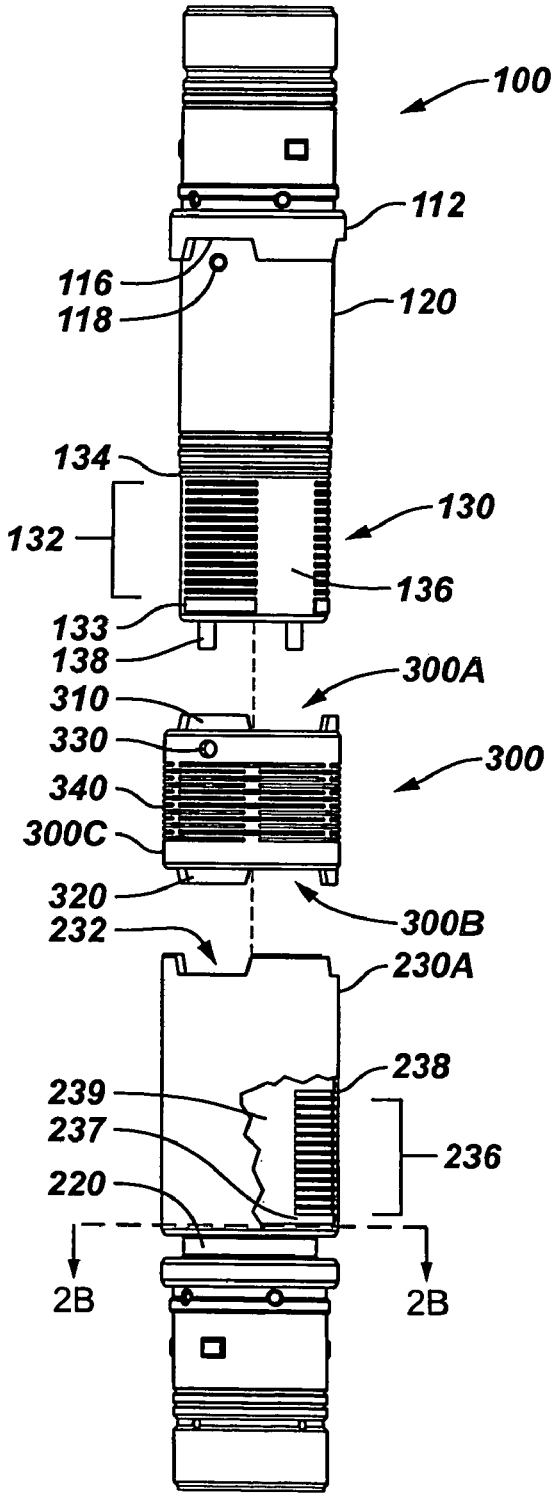
FIG. 2A is a schematic view of an embodiment of the present invention illustrating an upper perforating gun assembly, a lower perforating gun assembly and a locking sleeve.
Figure 2B:
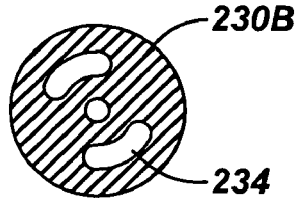
FIG. 2B is a cross-sectional view taken along line 2B—2B of FIG. 2A.
Figure 3:
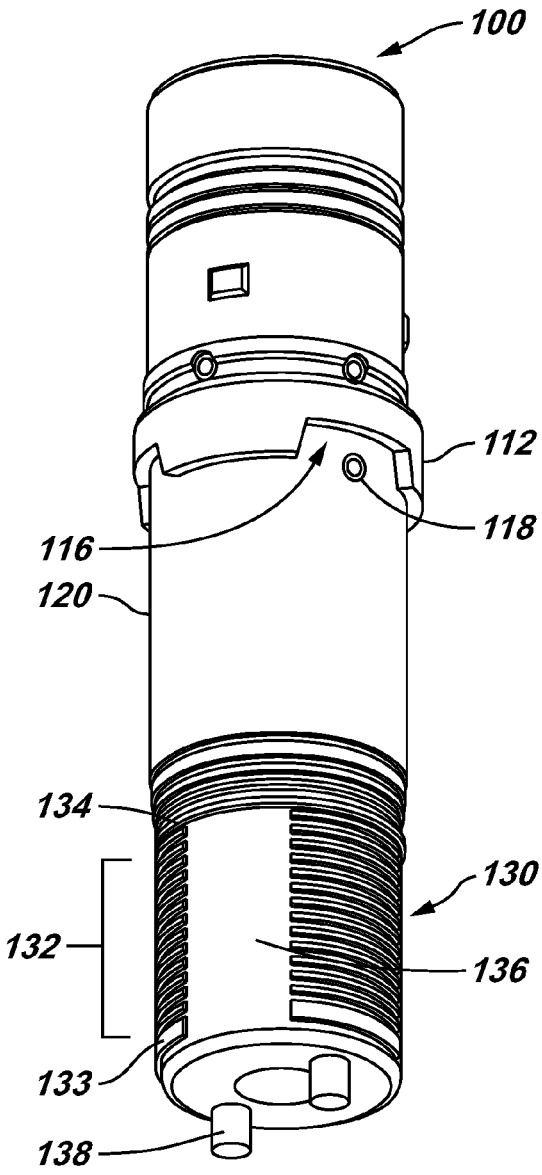
FIG. 3 is a perspective view of an embodiment of an upper perforating gun assembly in accordance with the present invention.
Figure 4:
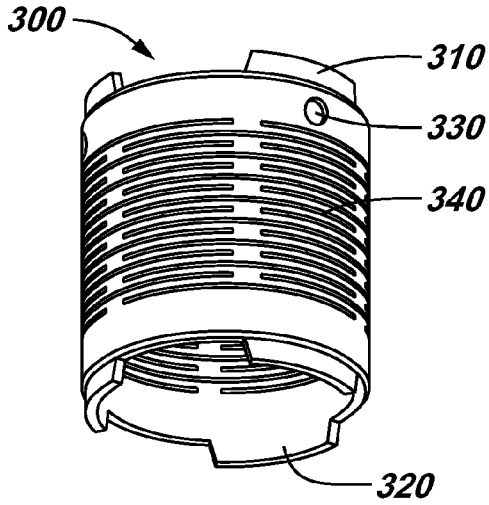
FIG. 4 is a perspective view of an embodiment of a locking sleeve accordance with the present invention.
Figure 5:
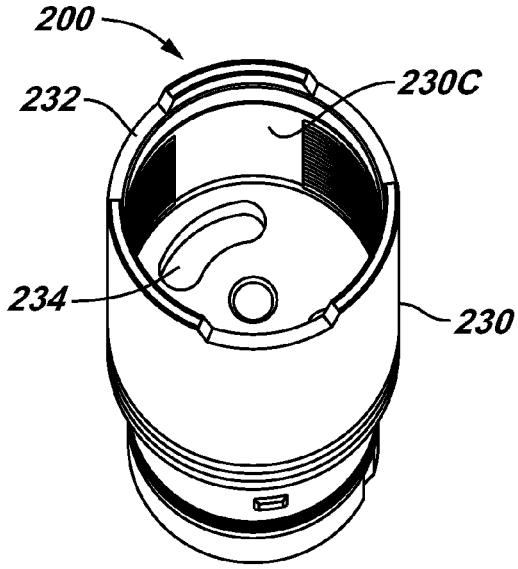
FIG. 5 is a perspective view of an embodiment of a lower perforating gun assembly in accordance with the present invention.

It is to be noted, however, that the appended drawings illustrate only typical embodiments of this invention and are therefore not to be considered limiting of its scope, for the invention may admit to other equally effective embodiments.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

In the specification and appended claims: the terms "connect", "connection", "connected", "in connection with", and "connecting" are used to mean "in direct connection with" or "in connection with via another element"; and the term "set" is used to mean "one element" or "more than one element". As used herein, the terms "up" and "down", "upper" and "lower", "upwardly" and downwardly", "upstream" and "downstream"; "above" and "below"; and other like terms indicating relative positions above or below a given point or element are used in this description to more clearly describe some embodiments of the invention. However, when applied to equipment and methods for use in wells that are deviated or horizontal, such terms may refer to a left to right, right to left, or other relationship as appropriate.

While embodiments of the present invention are described with respect to connecting perforating guns to form a perforating string, in further embodiments other types of downhole tools, devices, and/or elements are connected together using the connection system of the present invention. For example, the system of the present invention may be used to connect valves, packers, sand screens, expandable tubing, diverter tools, drilling tools, float equipment, hangers, casing/liner running tools, well evaluation or logging tools, measurement while drilling tools, hydraulic lines, hoses, and other completion, drilling, or servicing equipment. In addition, the system of the present invention may be used to connect perforating guns and other items such as those listed above in an enclosed chamber such as pressure control equipment that is mounted above a pressurized wellbore.

In downhole oilfield operations, a variety of tools are often coupled together to form a tool string to perform particular tasks in a well. As these tools are often times heavy, cumbersome, and/or difficult to align, a "hands-free" or non-manual connection is desirable. An embodiment of the present invention provides a hands-free connection system to facilitate connecting and aligning (vertically and/or radially) two downhole tools together for use in well operations. Moreover, an embodiment of the connection system of the present invention may be used as a component in an automated tool handling operation. For example, robotic pipe handlers may be used to convey two tools to the well site, suspend the tools over the well, and couple, align, and lock the tools together using the hands-free connection system.

With reference to FIG. 1, according to one embodiment of the present invention, a perforating string 10 is positioned above a wellbore 20 which may be lined with casing 22. In this illustrated embodiment, the perforating string 10 is suspended by a wireline 30 from a derrick 40 above the wellbore 20 in wireline-conveyed operations. However, in other embodiments, the perforating string may be suspended by tubing (e.g., coiled or jointed tubing) in tubing-conveyed operations, by rig handling equipment, drill pipe, or by any other conveying mechanism. Moreover, while this illustrated embodiment is used in land-based well operations, other embodiments of the connection system of the present invention may be used in offshore well operations.

Generally, according to an embodiment of the present invention, the gun string 10 includes an upper gun assembly 12 and a lower gun assembly 14 coupled together by a locking device 16. Each gun assembly 12, 14 includes a carrier 12A, 14A for housing charges and a detonating cord and an adapter 12B, 14B for coupling guns in series. Additional guns may be included in the perforating string 10, with additional locking devices 16 coupling the guns. The perforating string 10 may be formed by lowering and rotating the upper gun 12 into threaded engagement with the lower gun 14. The locking device 16, upon actuation, functions to lock the upper gun 12 and lower gun 14 together in a precise predetermined alignment.

More particularly, referring to FIGS. 2A–5, a connection system according to one embodiment of the present invention includes an upper perforating gun assembly 100, a lower perforating gun assembly 200, and a locking sleeve 300. Note, for illustration purposes, only the adapters of the gun assemblies are shown and not the carriers. It is understood by those skilled in the art that other embodiments of the present invention include gun carriers with integral adapters and gun carriers that connect directly together in series without an adapter.

The upper perforating gun assembly 100 is generally cylindrical in shape and includes a carrier (see FIG. 1), a shank 120, and a threaded portion 130. In one embodiment, the carrier may include a plurality of loading tubes for containing shaped charges. Alternatively, in another embodiment, the carrier may include a plurality of strips onto which capsule shaped charges are mounted.

The shank 120 of the upper perforating gun assembly 100 has a protruding ring 112 formed thereon having a plurality of tapered recesses 116 formed therein for engagement with the locking sleeve 300. The shank 120 further includes a threaded hole 118 for receiving a through-bolt for attaching the locking sleeve 300 to the upper perforating gun assembly 100.

The threaded portion 130 of the upper perforating gun assembly 100 includes a plurality of horizontal (i.e., non-spiral) threads 132, 133 protruding radially outward. The threads 132, 133 are arranged in columns having a selected width such that axial gaps 136 are formed between the columns. Moreover, the threaded portion includes a distinguishing feature that prevents engagement until proper vertical alignment is achieved. For example, in one embodiment, the bottom-most thread 133 in each column has a width greater than that of the other threads 132. In other embodiments, the wider thread 133 may be located at the top or in the middle of the other threads.

The threaded portion 130 of the upper perforating gun assembly 100 further includes a distinguishing feature that prevents the upper gun from over engaging the lower gun 200. For example, in one embodiment, a stop ring 134 is formed in the upper gun 100 above the threads 132. The stop ring 134 protrudes radially outward and is continuous such that it circumscribes the total perimeter of the threaded portion 130.

The threaded portion 130 of the upper perforating gun assembly 100 still further includes a set of two cylindrical keys 138 formed on the lower end of the upper perforating gun assembly 100 and protruding axially downward. The keys are positioned substantially equidistant from the central axis of the upper perforating gun assembly 100 and are spaced approximately 180 degrees apart. The number and position of the keys may vary. For example, by varying the number and/or position of the key, the keys may be used to ensure proper assembly (e.g., proper order of assembly). Moreover, the number and/or positioning of the keys may also be used to match tools that are to be connected to facilitate tool inventory control.

The lower perforating gun assembly 200 is also generally cylindrical in shape and includes a carrier (see FIG. 1), a clamping section 220, and a threaded housing 230. In one embodiment, the carrier may include a plurality of loading tubes for containing shaped charges. Alternatively, in another embodiment, the carrier may include a plurality of strips onto which capsule shaped charges are mounted.

The clamping section 220 of the lower perforating gun assembly 200 is formed to receive a clamping tool to prevent the lower perforating gun assembly from rotating during engagement with the upper perforating gun assembly 100. In further embodiments, instead of a clamping tool, other types of elements or mechanisms may be used to constrain axial rotation of the lower perforating gun assembly 200.

The threaded housing 230 of the lower perforating gun assembly 200 is tubular in shape and has an open top end 230A, a closed bottom end 230B (see FIG. 2B), and a threaded axial bore 230C formed therethrough. The open top end 230A has a plurality of tapered recesses 232 formed therein for engagement with the locking sleeve 300.

The threaded axial bore 230C of the lower perforating gun assembly 200 includes a plurality of horizontal (i.e., non-spiral) receiving threads 236, 237 formed therein. The receiving threads are formed radially inward to receive the threads 132, 133 of the upper perforating gun assembly 100. As with the threads 132, 133 of the upper perforating gun assembly 100, the receiving threads 236, 237 are arranged in columns having a selected width such that axial gaps 239 are formed between the columns. The threads 236, 237 of the lower perforating gun assembly 200 are arranged such that threads 132, 133 of the upper perforating gun assembly 100 can slide axially downward through the axial gaps 239 when aligned. Furthermore, the bottom-most thread 237 of the lower perforating gun assembly 200 has a width greater than that of the other threads 236 for receiving the bottom-most thread 133 of the upper perforating gun assembly 100. This insures that the upper perforating gun assembly 100 is fully engaged (vertically aligned) with the housing 230 of the lower perforating gun assembly 200 such that the upper assembly may be rotated. As with wider thread 133 of the upper gun 100, the wider receiving thread 237 may be located at the top or middle of the threads to facilitate vertical alignment of the perforating guns 100, 200.

Still furthermore, the receiving threads 236 prevent the upper perforating gun assembly 100 from over engaging the lower perforating gun assembly 200. For example, in one embodiment, the top-most thread 238 of the receiving threads 236 serves as a shoulder to engage the stop ring 134 and thereby halt further downward axial translation of the upper perforating gun assembly 100 within the housing 230. This insures that the upper perforating gun assembly is not overly engaged with the housing 230 of the lower perforating gun assembly 200 before the upper perforating gun assembly is rotated. However, other embodiments may include other mechanisms for preventing over engagement of the upper gun 100 and lower gun 200.

Figure 6:
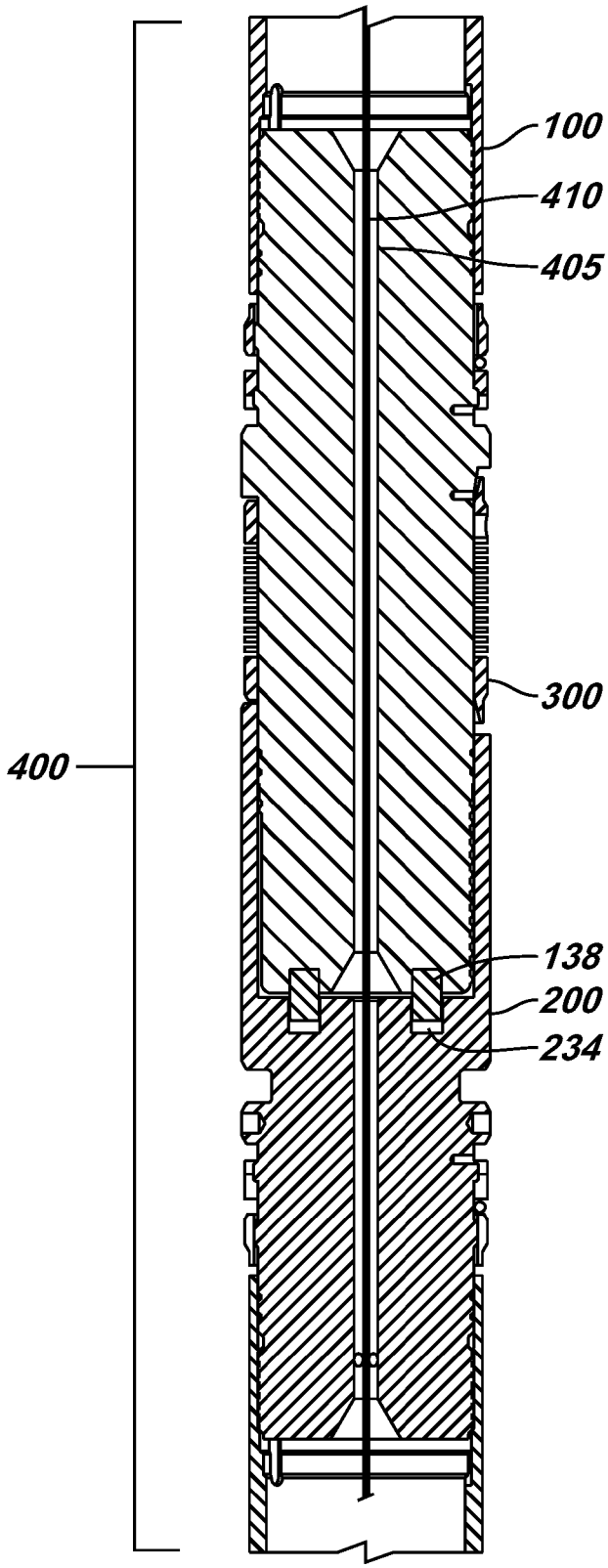
FIG. 6 is a cross-sectional view of an embodiment of the connection system of the present invention illustrating the upper perforating gun assembly coupled with the lower perforating gun assembly.

The closed bottom end 230B of the housing 230 has a set of two locking grooves 234 formed therein for receiving the set of keys 138 of the upper perforating gun assembly 100 (see also FIG. 6). Each locking groove 234 (for a two key system) forms an arc ranging from 30 to 90 degrees. In this illustrated embodiment, each locking groove 234 forms an arc of approximately 60 degrees. The locking grooves 234 limit the rotation of the upper perforating gun assembly 100 within the housing 230 of the lower perforating gun assembly 200. In further embodiments, the upper perforating gun assembly may include a different number and arrangement of cylindrical keys and locking grooves such that the degree of arc of each locking groove is different than 60 degrees.

The locking sleeve 300 is generally tubular in shape and may be fabricated from a suitable metal such as steel or a steel alloy. The locking sleeve 300 includes a top end 300A, a bottom end 300B, and a compressible body 300C with an axial bore formed therethrough.

The top end 300A of the locking sleeve 300 includes a plurality of tapered lugs 310 for engagement with the tapered recesses 116 of the upper perforating gun assembly 100.

The bottom end 300B of the locking sleeve 300 also includes a plurality of tapered lugs 320 for engaging the tapered recesses 232 of the lower perforating gun assembly 200.

The compressible body 300C of the locking sleeve 300 includes a bolt hole 330 formed therein for receiving a through-bolt for attachment of the locking sleeve to the upper perforating gun assembly 100. In other embodiments, instead of a through-bolt connection, other types of elements may be used to connect the locking sleeve 300 to the upper perforating gun assembly 100 including, inter alia, pins, screws, c-rings or other fasteners. The body 300C further includes a plurality of transverse slots 340 formed therein. The transverse slots 340 permit the locking sleeve 300 to compress like a spring in response to an external force to achieve a desired axial deflection. Furthermore, once the compressive force is removed, the locking sleeve 300 returns to its original state. The size and arrangement of the transverse slots 340 are selected to achieve the required deflection to permit the upper perforating gun assembly 100 to engage the lower perforating gun assembly 200.

In another embodiment of the present invention, instead of being connected to the upper perforating gun assembly 100, the locking sleeve 300 is integral with the upper gun.

With reference to FIG. 6, an embodiment of the present invention includes a perforating string 400 having an upper gun 100 and a lower gun 200 coupled together by a locking device 300 to form an axial bore 405 through the string. The axial bore 405 houses a detonating cord 410 and detonation transfer components. Once the perforating string is coupled and run downhole to a target depth, the detonating cord 405 is initiated to fire the shaped charges carried by the upper gun 100 and lower gun 200.

Figure 7A:
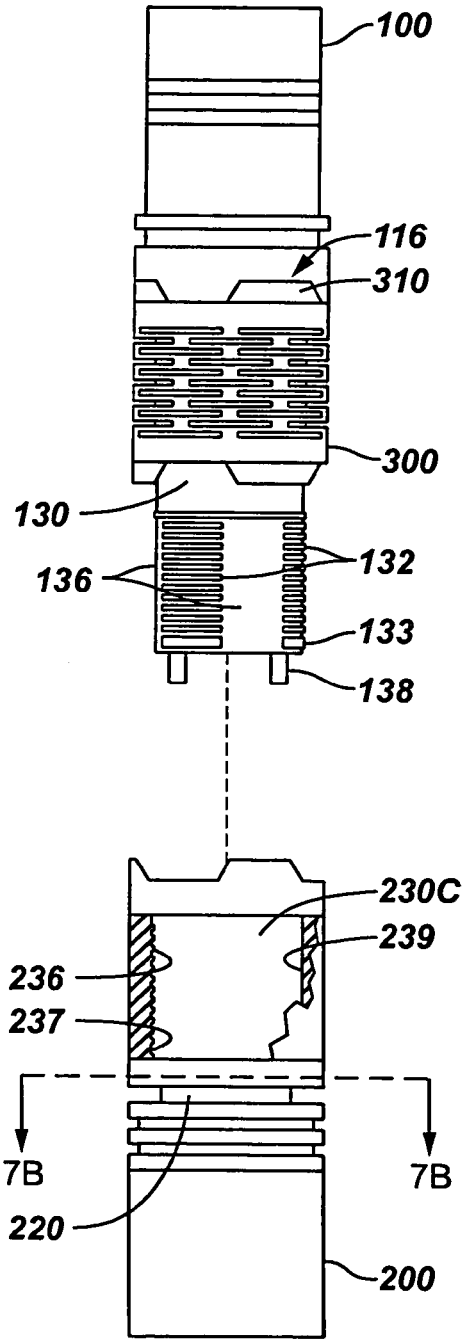
FIG. 7A is a profile view of an embodiment of the connection system of the present invention illustrating an upper perforating gun assembly and locking sleeve suspended over a lower perforating gun assembly.
Figure 7B:
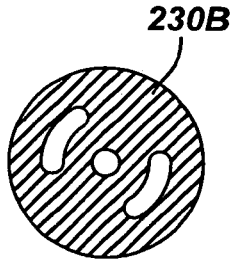
FIG. 7B is a cross-sectional view taken along line 7B—7B of FIG. 7A.

In operation, with respect to FIGS. 7A–10C, a perforating string is assembled at the surface with one or more sleeves 300 used to connect successive gun assemblies. As shown in FIGS. 7A and 7B, to connect two perforating gun assemblies 100, 200 together, the lower perforating gun assembly 200 is first suspended in place above the wellbore and is restrained at the clamping section 220 by a clamping tool to prevent the gun assembly from falling into the wellbore and/or rotating. The locking sleeve 300 is attached to the upper perforating gun assembly 100 such that the tapered lugs 310 of the locking sleeve mate with the tapered recesses 116 of the upper perforating gun assembly respectively. The upper perforating gun assembly 100 is then moved by pipe handling equipment to be suspended over the lower perforating gun assembly 200. Once suspended, the upper perforating gun assembly 100 is rotated above the lower perforating gun assembly 200 until the threads 132, 133 of the upper assembly are aligned with the axial gaps 239 formed in the axial bore 230C of the lower assembly and the receiving threads 236, 237 of the lower assembly are aligned with the axial gaps 136 formed on the threaded portion 130 of the upper assembly.

Figure 8A:
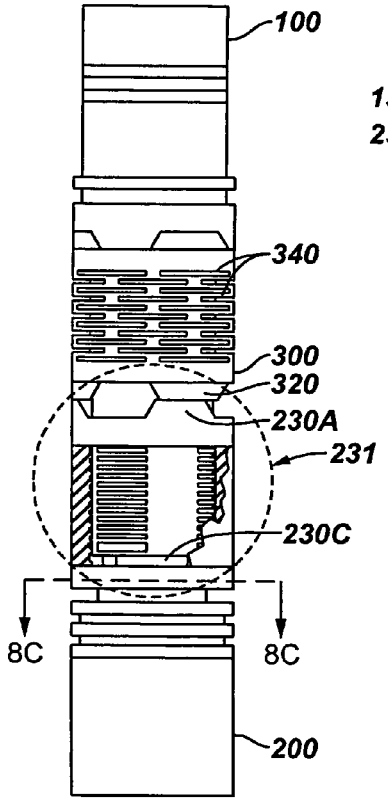
FIG. 8A is a profile view of an embodiment of the connection system of the present invention illustrating the upper perforating gun assembly and locking sleeve being lowered into engagement with the lower perforating gun assembly.
Figure 8B:
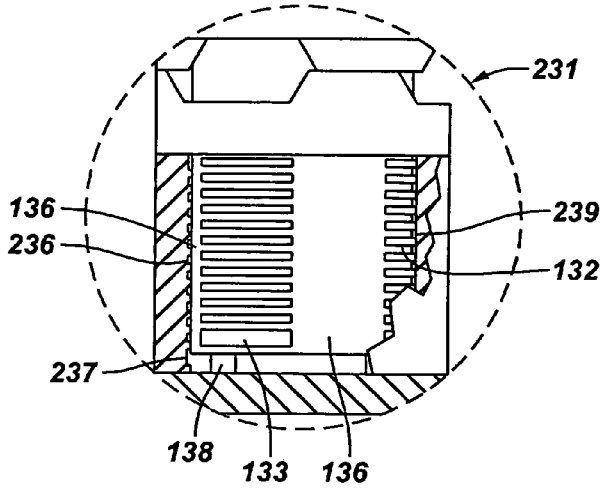
FIGS. 8B, 9B and 10B are enlarged views of portions of FIGS. 8A, 9A and 10A, respectively.
Figure 8C:
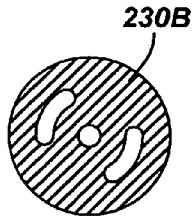
FIG. 8C is a cross-sectional view taken along line 8C—8C of FIG. 8A.

As shown in FIGS. 8A, 8B and 8C, the upper perforating gun assembly 100 is lowered into the threaded axial bore 230C of the lower perforating gun assembly 200. The threads 132 (see FIG. 8B, which depicts an enlarged view of the tool section 231 of FIG. 8A), 133 of the upper perforating gun assembly 100 slide through the axial gaps 239 formed in the axial bore 230C of the lower perforating gun assembly 200 and the axial gaps 136 formed on the threaded portion 130 of the upper assembly slide across the receiving threads 236, 237 of the lower assembly. The upper perforating gun assembly 100 translates axially downward through the axial bore 230C of the lower perforating gun assembly 200 until the tapered lugs 320 of the locking sleeve 300 contact the upper end 230A of the lower assembly.

Figure 9A:
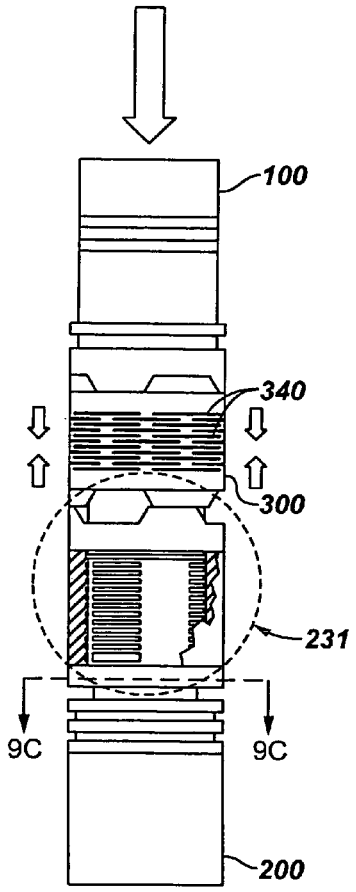
FIG. 9A is a profile view of an embodiment of the connection system of the present invention illustrating the locking sleeve being compressed against the lower perforating gun assembly by the upper perforating gun assembly such that the upper gun assembly can be threaded into engagement with the lower gun assembly.
Figure 9B:
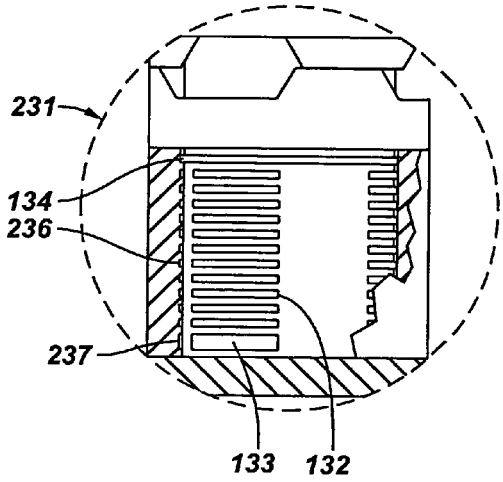
Figure 9C:
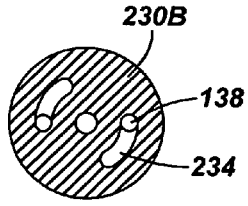
FIG. 9C is a cross-sectional view taken along line 9C—9C of FIG. 9A.

As shown in FIGS. 9A, 9B and 9C, a predetermined external force is then applied to the upper perforating gun assembly 100 to compress the transverse slots 340 of the locking sleeve 300 such that the locking sleeve deflects axially downward. The deflection is halted once the stop ring 134 (see FIG. 9B, which depicts enlarged view of the tool section 231 of FIG. 9A) contacts the top-most thread 238 of the receiving threads 236. At this point, the threads 132 are laterally aligned with the receiving threads 236, the wide thread 133 is aligned with the wide receiving thread 237, and the cylindrical keys 138 of the upper perforating gun assembly 100 are engaging the locking grooves 234 of the lower perforating gun assembly 200 such that the upper assembly is free to rotate within the axial bore 230C of the lower assembly.

Figure 10A:
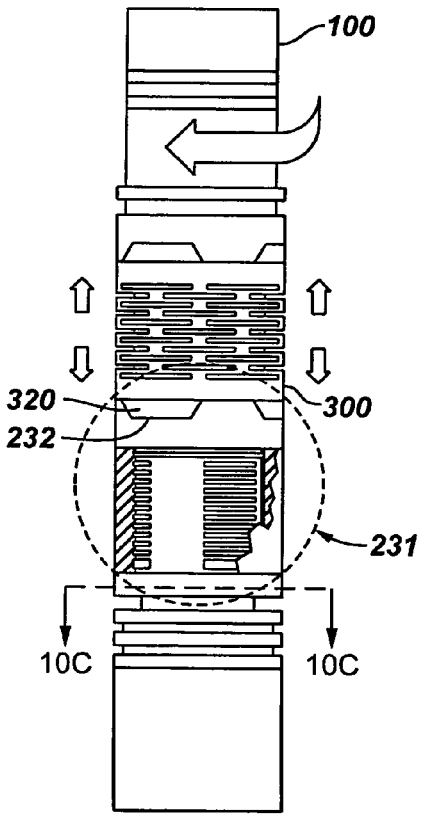
FIG. 10A is a profile view of an embodiment of the connection system of the present invention illustrating the upper perforating gun assembly being rotated into threaded engagement with the lower perforating gun assembly such that the lugs of the locking sleeve align with the notched recesses of the lower gun assembly thus allowing the locking sleeve to decompress and lock the upper gun assembly to the lower gun assembly.
Figure 10B:
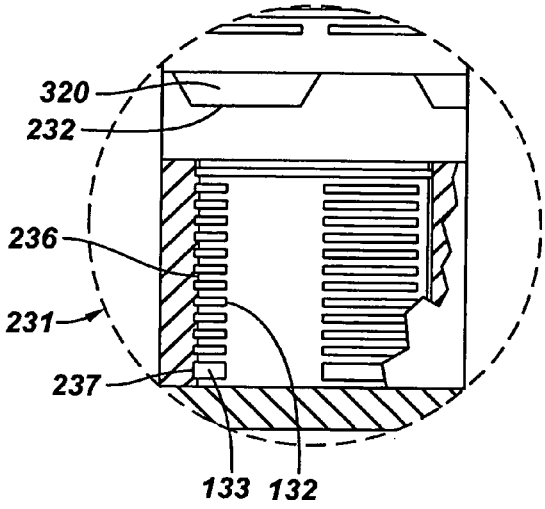
Figure 10C:
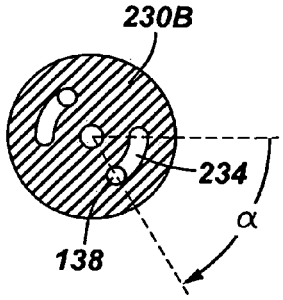
FIG. 10C is a cross-sectional view taken along line 10C—10C of FIG. 10A.

As shown in FIGS. 10A, 10B and 10C, the upper perforating gun assembly 100 is rotated approximately 60 degrees until the cylindrical keys 138 (see FIG. 10C) of the upper perforating gun assembly 100 reach the end of the locking grooves 234 of the lower perforating gun assembly 200. At this point, the threads 132 (see FIG. 10B, which depicts an enlarged view of the tool section 231 of FIG. 10A) are engaging the receiving threads 236 and the wide thread 133 is engaging the wide receiving thread 237. Moreover, as the tapered lugs 320 of the locking sleeve 300 are aligned with the tapered recesses 232 of the lower perforating gun assembly 200, the sleeve decompresses axially and lengthens to lock the upper perforating gun assembly 100 into threaded engagement with the lower perforating gun assembly 200. In this way, a more reliably aligned perforating string may be formed.

In the event that the upper perforating gun assembly 100 is to be disconnected from the lower perforating gun assembly 200, a predetermined torquing force is needed to shift the lugs 320 out of the recesses 232 and simultaneously compress the locking sleeve 300. Once this is accomplished, the threads 132, 133 of the upper perforating gun assembly 100 are shifted back into the axial gaps 239 of the lower perforating gun assembly 200 and the upper assembly may be lifted out of the axial bore 230C of the lower assembly. It will be understood by those skilled in the art that the torquing force required to disconnect the upper assembly 100 from the lower assembly 200 is a function of the slope of the tapered lugs 320 and recesses 232 and the spring constant of the locking sleeve 300.

Figure 11:
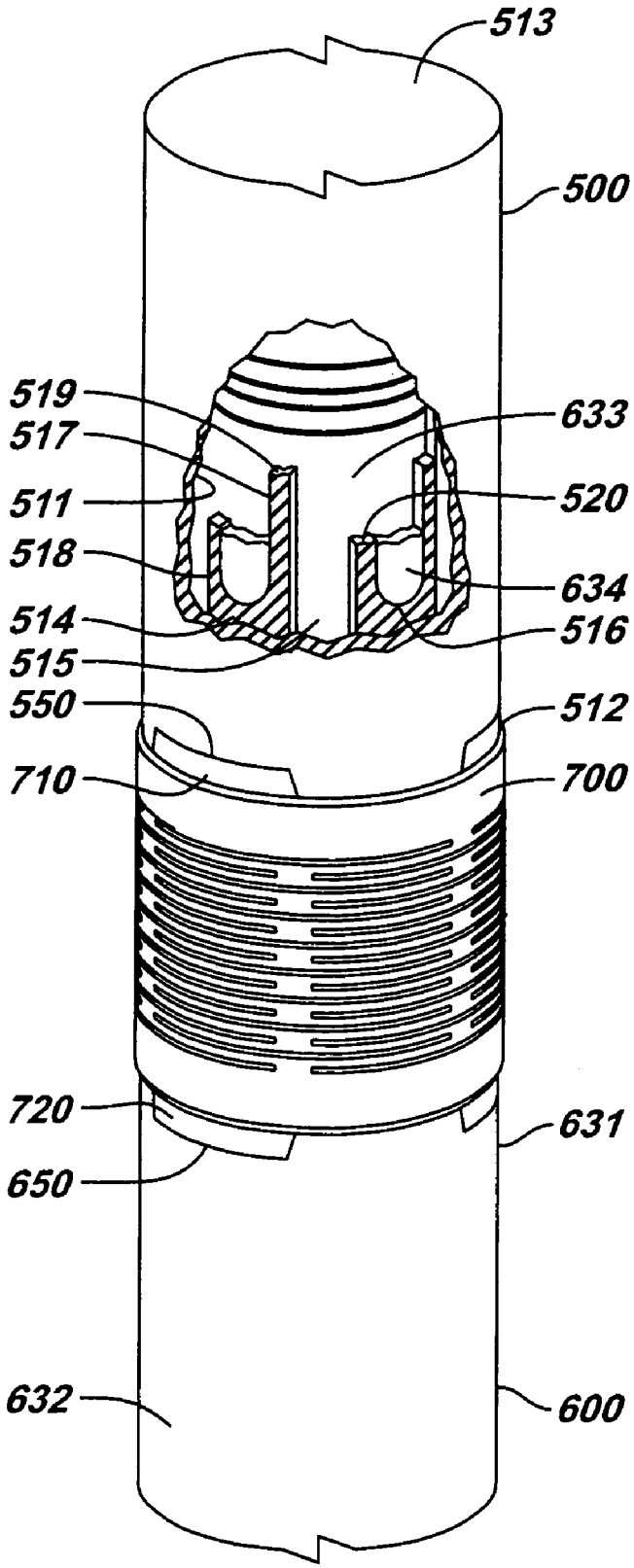
FIG. 11 is a perspective view of an embodiment of the present invention illustrating the locking sleeve used in a rib and groove-type connection.

In other embodiments of the present invention, other mechanisms may be employed (besides the horizontal thread embodiments described above) to axially align two downhole tools such that locking sleeve can lock the two tools together in radial alignment. For example, the rib and groove connection illustrated in FIG. 11 provides a mechanism to axially align two downhole tools. This connection is similar to that disclosed in U.S. Pat. No. 6,257,792, issued Jul. 10, 2001, which is incorporated herein by reference. This embodiment includes: (1) an upper tool assembly 500, (2) a lower tool assembly 600, and (3) a locking sleeve 700. The upper tool assembly 500 includes an axial bore 511 formed therethrough, a first end 512, and a second end 513. At the first end 512 of the upper tool assembly 500, the longitudinal bore 511 includes a plurality of ribs 514 that are preferably evenly spaced about the circumference of the longitudinal bore 511, and a plurality of grooves 515 defined between the ribs 514. Each rib 514 includes a recess 516 disposed between a first leg 517 and second leg 518. The first leg 517 includes a distal end 519 and the second leg 518 includes a distal end 520. The distal end 520 of the second leg 518 is located closer to the first end 512 of the upper tool assembly 500 than is the distal end 519 of the first leg 517. The first end 512 includes one or more tapered recesses 550 formed therein.

Still with reference to FIG. 11, the lower tool assembly 600 includes a shoulder 631 adjacent to a main body portion 632 and a pin member 633. The pin member 633 includes a plurality of lugs 634 for mating with the recesses 516 in the ribs 514 on the upper tool assembly 500. The shoulder 631 includes one or more tapered recesses 650 formed therein.

The locking sleeve 700 may be similar to that described above with respect to the horizontal thread embodiments. The locking sleeve 700 includes a top end, a bottom end, and a compressible body with an axial bore formed therethrough. The top end of the locking sleeve 700 includes one or more tapered lugs 710 for engagement with the tapered recesses 550 of the upper tool assembly 500. The bottom end of the locking sleeve 700 includes one or more tapered lugs 720 for engaging the tapered recesses 650 of the lower tool assembly 600. The compressible body of the locking sleeve 700 includes a mechanism (as described more fully above with respect to the horizontal thread embodiments) to connect the locking sleeve to the upper tool assembly 500. The body also includes transverse slots 340 to facilitate axial deflection.

To operate this embodiment of the hands-free connection system of the present invention, the upper tool assembly 500 is lowered into engagement with the lower tool assembly 600 such that the lugs 634 on the pin 633 slide into the grooves 515 of the bore 511 until the shoulder 631 on the lower assembly abuts against the lower end of the locking sleeve 700. The sleeve 700 is compressed such that the lugs 534 extend past the distal ends 520 of the second legs 518 of the ribs 514 (but not past the distal ends 519 of the second legs 517). The upper tool assembly 500 is rotated a fraction of a full 360 degree turn until the lugs 634 contact the first legs 517 on the ribs 514 and are positioned adjacent their corresponding recesses 516. At this point, the lugs 720 of the sleeve 700 are aligned with the corresponding recesses 650 of the lower assembly 600 and the sleeve is free to decompress axially downward to slide the lugs 634 of the lower assembly into the corresponding recesses 516 of the upper assembly 500. Thus, an axially and radially aligned coupling of the upper tool assembly 500 and lower tool assembly 600 is achieved.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention.

What is claimed is:

1. A system for forming a tool string, the system comprising:

two downhole tools adapted to be coupled in series via a connection comprising a plurality of horizontal threads formed on one tool and a plurality of receiving threads formed on the other tool, the receiving threads adapted to receive the horizontal threads, wherein the connection restrains axial translation of one tool with respect to the other; and a compressible sleeve arranged between two tools, the sleeve adapted to facilitate axial rotation between the tools when substantially compressed, the sleeve adapted to impede axial rotation between the tools when substantially decompressed.

2. The system of claim 1, wherein the connection comprises a plurality of ribs form on one tool and a plurality of grooves formed on the other tool, the grooves adapted to receive the ribs.

3. The system of claim 1, wherein the tool string is formed at a surface location before being run into a wellbore.

4. The system of claim 1, wherein the two downhole tools are guns and the tool string is a perforating string.

5. A connection system, comprising:

a first downhole tool having a threaded end;

a second downhole tool having a threaded end adapted to receive the threaded end of the first downhole tool, the second downhole tool having a tapered recess formed on the threaded end; and a sleeve having a tapered element formed on one end, the tapered element shaped to mate with the tapered recess of the second downhole tool, the sleeve connectable to the first downhole tool such that the tapered element is biased toward the second downhole tool.

6. The connection system of claim 5, wherein the sleeve is axially deflectable in response to the compressive force.

7. The connection system of claim 5, wherein the threaded end of the second downhole tool is a threaded axial bore having an open end for receiving the threaded end of the first downhole tool and a closed end having a plurality of radial grooves formed therein.

8. The connection system of claim 7, wherein the first downhole tool comprises a plurality of keys formed on the threaded end, the keys adapted to engage the grooves of the second downhole tool.

9. The connection system of claim 8, wherein each radial groove forms a substantially 60 degree arc.

10. The connection system of claim 5, wherein the threaded end of the first downhole tool comprises a plurality of horizontal threads, the horizontal threads arranged in axial columns having a predetermined width.

11. The connection system of claim 10, wherein the threaded end of the second downhole tool comprises a plurality of horizontal receiving threads adapted to receive the threads of the first downhole tool, the horizontal receiving threads of the second downhole tool arranged in axial columns having a predetermined width substantially equal to the width of the axial columns of the first downhole tool.

12. The connection system of claim 11, wherein the horizontal threads nearest the end of the first downhole tool have a width greater than the width of the other threads, and wherein the horizontal receiving threads farthest from the end of the second downhole have substantially the same width as the horizontal threads nearest the end of the first downhole tool.

13. The connection system of claim 11, wherein the first downhole tool comprises a horizontal ring formed around the circumference at a location farther from the end of the first downhole tool than the horizontal threads, the ring protruding radially outward to engage the horizontal receiving threads of the second downhole tool.

14. The connection system of claim 5, wherein the first downhole tool and the second downhole tools are perforating guns.

15. A tool string connector comprising:

a tubular body having two open ends, the tubular body having a plurality of slots formed therein to reserve space for axial deflection of the tubular body in response to a compressive force, the tubular body being connectable to a first downhole tool; and a tapered element formed on one end of the tubular body, the tapered element formed to engage with a mating tapered element on a second downhole tool.

16. The tool string connector of claim 15, wherein the tubular body is adapted to deflect to allow the first downhole tool to engage the second downhole tool.

17. The tool string connector of claim 16, wherein the tubular body is adapted to substantially decompress to engage the tapered element with the mating tapered element of the second downhole tool.

18. The tool string connector of claim 16, wherein the first downhole tool and the second downhole tools are perforating guns.

19. The tool string connector of claim 15, wherein the slots comprise substantially longitudinal slots.

20. A connection system for use in well operations, the connection system comprising:

a first downhole tool having a top end and a bottom end, the first downhole tool comprising a plurality of threads formed on the bottom end;

a second downhole tool having a top end and a bottom end, the second downhole tool comprising: (i) a threaded axial bore formed in the top end for receiving the threads of the first downhole tool, and (ii) at least one tapered element foamed on the top end; and a sleeve connected to the first downhole tool and having a top end and a bottom end, the sleeve comprising at least one tapered element formed on the bottom end to mate with the tapered element of the second downhole tool, the sleeve moveable between: (i) a compressed state, wherein the first downhole tool may rotate into threaded engagement with the second downhole tool, and (ii) a substantially decompressed state wherein the tapered element of the sleeve mates with the tapered element of the second downhole tool to prevent the downhole tools from rotating out of threaded engagement.

21. The connection system of claim 20, wherein the first downhole tool and the second downhole tools are perforating guns.

22. A method comprising:

connecting two downhole tools in series by compressing, a sleeve and rotating one tool into threaded engagement with the other tool; and locking the tools together by decompressing the sleeve, wherein the sleeve comprises lugs to engage each tool to prevent the tools from rotating out of threaded engagement.

23. The method of claim 22, wherein the downhole tools are perforating guns.

24. A method for forming a tool string for use in well operations, the method comprising:

compressing a sleeve arranged between two tools;

rotating one tool into threaded engagement with the other tool; and decompressing the sleeve to cause features of the sleeve to engage features of the tools to lock the tools together in a predetermined alignment.

25. The method of claim 24, wherein the tool string is a perforating string and the two tools are perforating guns.

26. Apparatus for aligning two downhole tools, comprising:

an axially compressible body adapted to connect with one downhole tool and be compressed to connect the tools together; and a tapered element formed on one end of the body, the tapered element adapted to engage the other downhole tool.

27. The apparatus of claim 26, wherein the two downhole tools are perforating guns.

28. A method comprising:

connecting two downhole tools in series by compressing a sleeve and rotating one tool into threaded engagement with the other tool;

locking the tools together by decompressing the sleeve, wherein the sleeve comprises lugs to engage each tool to prevent the tools from rotating out of threaded engagement;

unlocking the tools by compressing the sleeve, wherein the sleeve disengages from one of the downhole tools; and disconnecting the tools by rotating one tool out of threaded engagement with the other tool.

29. The method of claim 28, wherein the downhole tools comprise perforating guns.

* * * * *